US005528910A

United States Patent [19]

Azais

[11] Patent Number: 5,528,910

[45] Date of Patent: Jun. 25, 1996

[54] DOUBLE-FACED WEFT KNITTED FABRIC, NOTABLY FOR LEISURE CLOTHES

[76] Inventor: Christine Azais, 11, Avenue Albert Rouvière, 81200 Mazamet, France

[21] Appl. No.: 129,777

[22] Filed: Sep. 30, 1993

[30] Foreign Application Priority Data

Oct. 16, 1992 [FR] France ..... 92 12668

[51] Int. Cl.[6] ..... D04B 7/04

[52] U.S. Cl. ..... 66/197; 66/202

[58] Field of Search ..... 428/254; 66/197, 66/202

[56] References Cited

FOREIGN PATENT DOCUMENTS 948003 2/1956 Germany .
0350821 6/1931 United Kingdom .

OTHER PUBLICATIONS

Prelog, "New Fabrics from Old Machines," *Knitting Times*, vol. 40., No. 38, Sep. 13, 1971.

*Primary Examiner*—Christopher W. Raimund
*Attorney, Agent, or Firm*—Ladas & Parry

[57] ABSTRACT

The double-faced knitted fabric, notably for leisure clothes, according to the invention, has one face with a surface in a first material, preferably cotton, whether pure or in a mixture, and the other face with a surface in a second material, preferably wool, whether pure or in a mixture. The knitted fabric is obtained on at least three feeds, two feeds with a full cardigan type knitting with a yarn of the first material and a second yarn of the second material and one feed with a jersey type knitting using a third yarn having the first material at least on the surface.

In particular, this third yarn can be an elastic yarn, comprising for example, a covered elastomer yarn whose cover is in the first material.

6 Claims, 1 Drawing Sheet

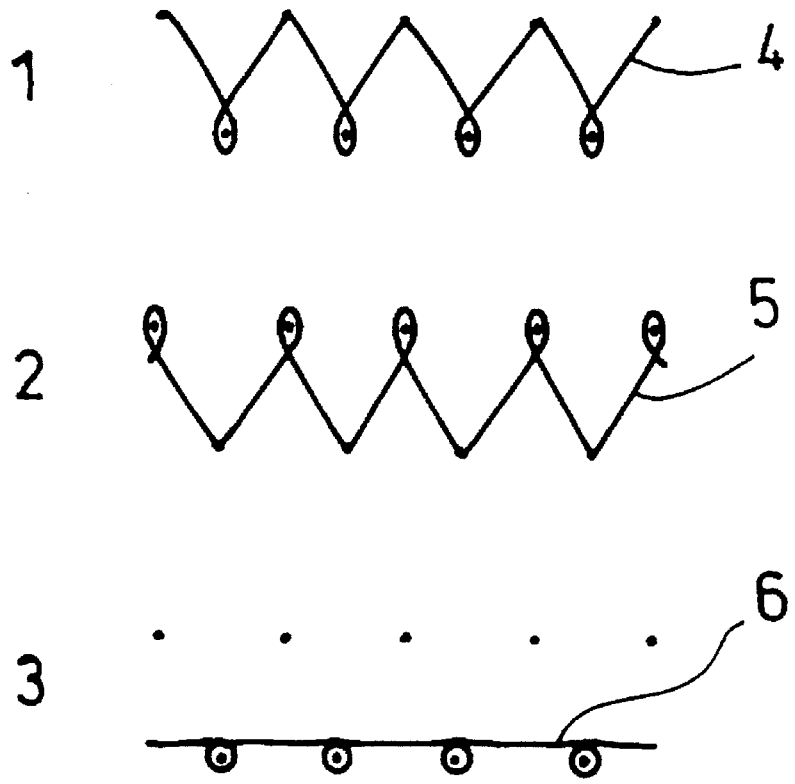
1
4
2
5
3
6

DOUBLE-FACED WEFT KNITTED FABRIC, NOTABLY FOR LEISURE CLOTHES

FIELD OF THE INVENTION

The present invention relates to a knitted fabric intended more particularly although not exclusively for making leisure clothes. It relates in particular to a weft knitted fabric or to a knitted fabric with sunk loops, having two separate layers or faces, the surface of each face being in a different material. The invention further relates to a knitting process for producing said knitted fabric.

BACKGROUND OF THE INVENTION

The advantage of the double-faced knitting is that it can combine, in the same structure, the characteristics of each of the two faces, which are selected as a function of the requirements linked to the use to be made of the final garment. For example, if the garment is designed to be in contact with the wearer's skin, then it should be soft to the touch. In the case of leisure wear, the inside face should have perspiration-absorbing properties, and the outside face should ensure a good thermal insulation.

Double-faced knitted fabrics have already been proposed, of which the surface of each face is in a different material. For example, in documents DE-2 530 806 and DE-3 409 965, the outside face is in wool while the inside face, which is in contact with the wearer is respectively in cotton for DE-2 530 806 and in silk for DE-b 3 409 965.

A number of knitting techniques have already been proposed for producing the double-faced knitting. The first one consists in a knitting of plaited jersey type in which a single-knit knitting machine is fed with two yarns of different material; in this case, the two yarns must be quite separate and presented to the needles such that one is always placed on the wrong side and the other on the right side. This first technique requires a very accurate control of the yarns-feeding members; the resulting knitting is not thick and not sufficiently extensible. A thicker knitting can be obtained according to a variant of this first technique, by producing on a conventional rib knitting machine a double-faced plaited knitting.

According to the second technique, the double-faced knitting is produced on three feeds: the first two feeds being formed of two quite separate layers of stocking stitch, and the third being a linking yarn of very low count, generally a synthetic filament which, by curling, interlocks the two other layers. This second technique is very easy to use but it has the disadvantage of requiring the presence of a linking yarn which is made of a third material, and it feels like two juxtaposed knittings.

The third technique is the resultant from the second in that interlocking of the two layers is achieved by one of the two components. Using this technique with a circular knitting machine, the knitting is obtained from two feeds: in one is the yarn of the first material and all the needles on the dial are working, and in the other is the yarn of the second material and all the needles of the cylinder are working; the two layers are interlocked either by looping the yarn of the first material on the needles of the cylinder or by looping the yarn of the second material on the needles of the dial. The formation of the layers in either one of the two main components makes the structure of the stitch rather unstable. The knitting is extensible enough but its elasticity is poor and at the finishing stage, the dimensional stability obtained is often inadequate.

FIELD OF THE INVENTION

It is the object of the present invention to provide a double-faced knitted fabric which overcomes the aforesaid disadvantages.

This object is reached, according to the invention, with a double-faced knitting which has, in known manner, one face with a surface in a first material and the other face with a surface in a second material.

Characteristically, the knitted fabric according to the invention is obtained in at least three feeds, two feeds with a full cardigan type knitting using a yarn in the first material and a yarn in the second material and one feed with a jersey type knitting using a third yarn of the first material, at least on the surface.

It is the combination in the same knitting of two wellknown knitting methods, i.e. the full cardigan and the jersey which gives the effect wanted for the double-faced knitting, notably for leisure clothes, according to the invention. The full cardigan produced with two yarns of different materials, makes it possible to obtain the structure proper of the double-faced knitting, while the stocking stitch enables the control of the extensibility of the knitting and also the effect of separation of the two faces.

Understandably, the invention comes within the third technique described hereinabove, insofar as the interlocking of the two layers is achieved by one of the two components. It is nevertheless to the Applicant's credit to have found the specific knitting method which has made it possible to eliminate the aforesaid drawbacks Preferably, but non-restrictively, the first material which constitutes one of the yarns of the full cardigan and the yarn of the jersey and which corresponds to one of the faces of the knitting, is cotton, either pure or in a mixture, and the second material is wool, either pure or in a mixture.

According to a variant of embodiment, the third yarn knitted with a stocking stitch is an elastic yarn, in that for example it comprises a covered elastomer yarn, i.e. a yarn with a core in elastomer and a cover in the first material. This particular disposition contributes to further improving the control of the extensibility and of the elasticity of the knitted fabric.

Preferably, when one of the faces of the knitting is in cotton, said face has undergone a mechanical finish treatment, such as for example, at least one run on a card, thus developing part of the cotton fibers on the surface of the face treated in this way. The resulting knitting then has a sorer feel and also a higher absorbing power.

Advantageously, when one of the faces of the knitting is in wool, said knitting has received, on its outside face, a chemical water-proofing type treatment. This particular disposition allows the production of a leisure garment which has, not only all the wanted properties, but also a streaming effect on its outside face, which is repellent to water.

BRIEF DESCRIPTION OF THE DRAWING

The present invention will be more readily understood on reading the following description of an embodiment of a double-faced knitted fabric of which one face is in cotton and the other in wool, which fabric is obtained by knitting in combination, the full cardigan stitch the stocking stitch, as illustrated in the accompanying drawing in which the single figure represents a diagram of the knitting.

DESCRIPTION OF PREFERRED EMBODIMENT

A double-faced knitted fabric is produced on a flat knitting machine known under the designation DUBIED Jet 3 F, which knitted fabric is intended for the production of leisure clothes, according to the invention.

Said knitted fabric comprises a face whose surface is in cotton: this is the face which is on the inside of the garment. The other face has a wool surface: this is the face which is on the outside.

In characteristic manner, said knitted fabric is obtained on three feeds, by knitting on two successive feeds a full cardigan stitch with a first yarn of cotton and a second yarn of wool, and by knitting on the third feeder a jersey with a third yarn of cotton.

This knitting method is illustrated by the diagram shown in the figure, which illustrates the sequence of the three feeds 1,2 and 3. The first two feeds 1 and 2 produce the two complementary elements of the full cardigan the first one with a cotton yarn 4 and the second one with a wool yarn 5. The third feed 3 produces the interlock part with a cotton yarn 6.

In one particular example of embodiment, the two cotton yarns 4, 6 are both 100% combed cotton yarns with two strands of metric count 30. The wool yarn 5 is a 100% combed wool yarn with two strands of metric count 28.

To emphasize the separation of the two faces of the knitted fabric, the controls of the flat knitting machine are adjusted so as to obtain a length of absorbed yarn for the cotton yarn 6 which is at the most equal to those of the two other yarns 4, 5. Preferably, the length of absorbed yarn for the cotton yarn 6 is less than that of the wool yarn 5 which is itself less than that of the second cotton yarn 4. With this specific adjustment, it is possible to accentuate to a maximum the relief of the full cardigan on the two faces, while controlling the extensibility of the knitted fabric with the jersey. It is of course also possible to produce the knitted fabric according to the invention on other flat double-knit machines than the DUBIED Jet 3 machine as well as on circular knitting machines equipped with dial and cylinder.

Moreover, the cotton yarn 6 used for the stocking stitch knitting can be different from the cotton yarn 4 used for the inside face of the full cardigan knitting. For example, the jersey can be constituted of an elastomer yarn covered with cotton. In this case, the knitting linkage can be raised to four or five feeds.

The double-faced knitted fabric according to the invention is particularly intended for producing leisure and relaxing clothes; It will also find an application in the production of garments for children, babies or old people.

It is also left to the discretion of the man skilled in the art to select the materials constituting the yarns used in the knitted fabric according to the invention, as a function of the properties required for the garment to be produced, among all the natural fibers, whether pure or in a mixture, of animal or vegetable origin, or all the chemical, synthetic or artificial fibers whether pure or in a mixture.

What is claimed is:

1. A double-faced knitted fabric wherein one face comprises a first material on the surface and the other face comprises a second material on the surface, said knitted fabric is formed with three feeds, two feeds of which are in a full cardigan type knitting wherein one of the feeds is a yarn of the first material and the other feed is a yarn of the second material with the second material forming the surface of the other face of the knitted fabric, and the third feed of which is a jersey stitch of a third yarn of the first material forming the surface of said one face of the knitted fabric.

2. The knitted fabric as claimed in claim 1, wherein the first material, which constitutes one of the yarns of the full cardigan knitting and the yarn of the jersey knitting and which is comprised in one of the faces of the knitted fabric, is cotton, whether pure or in a mixture, while the second material is wool, whether pure or in a mixture.

3. The knitted fabric as claimed in claim 1, wherein the third yarn knitted in jersey is an elastic yarn.

4. The knitted fabric as claimed in claim 1, wherein one of the faces of the knitted fabric, which comprises cotton on its surface, has undergone a mechanical finishing treatment.

5. The knitted fabric as claimed in claim 1, wherein one of the faces of the knitted fabric, which comprises wool on its surface, has undergone a chemical water-proofing type treatment.

6. The knitted fabric as claimed in claim 3, wherein the third yarn knitted in jersey comprises an elastomer yarn covered in the first material.

* * * * *